US008306470B2

(12) United States Patent
Akamatsu et al.

(10) Patent No.: US 8,306,470 B2
(45) Date of Patent: Nov. 6, 2012

(54) CLEANING DEVICE AND IMAGE FORMING APPARATUS USING THE SAME

(75) Inventors: Hiroaki Akamatsu, Kanagawa (JP); Makoto Sakanobe, Kanagawa (JP); Yuichi Fukuda, Kanagawa (JP); Ryosuke Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 588 days.

(21) Appl. No.: 12/545,135

(22) Filed: Aug. 21, 2009

(65) Prior Publication Data

US 2010/0247189 A1 Sep. 30, 2010

(30) Foreign Application Priority Data

Mar. 26, 2009 (JP) ..... 2009-077548
Mar. 26, 2009 (JP) ..... 2009-077549

(51) Int. Cl.
*G03G 21/00* (2006.01)

(52) U.S. Cl. ..... 399/351

(58) Field of Classification Search ..... 399/350, 399/351, 123

See application file for complete search history.

(56) References Cited

U.S. PATENT DOCUMENTS

| | | | | |
|---|---|---|---|---|
| 5,438,400 | A * | 8/1995 | Kuribayashi et al. | 399/350 |
| 5,450,185 | A * | 9/1995 | Kuribayashi et al. | 399/350 |
| 5,517,294 | A * | 5/1996 | Ogiri et al. | 399/351 |
| 5,768,676 | A * | 6/1998 | Hokari et al. | 399/351 |
| 6,128,461 | A | 10/2000 | Yoshikawa | |
| 6,137,973 | A * | 10/2000 | Nishiuwatoko et al. | 399/111 |
| 2003/0035668 | A1 | 2/2003 | Endo et al. | |
| 2003/0156869 | A1 * | 8/2003 | Karakama et al. | 399/350 |
| 2007/0041761 | A1 * | 2/2007 | Kim | 399/351 |
| 2007/0154239 | A1 * | 7/2007 | Fukunaga et al. | 399/159 |
| 2008/0063448 | A1 * | 3/2008 | Hozumi et al. | 399/350 |

FOREIGN PATENT DOCUMENTS

| | | |
|---|---|---|
| JP | 06-318020 | 11/1994 |
| JP | 11-174922 | 7/1999 |
| JP | 2003-43895 | 2/2003 |
| JP | 2004-125931 | 4/2004 |
| JP | 2006-084878 | 3/2006 |
| JP | 2008-139750 | 6/2008 |

* cited by examiner

*Primary Examiner* — Walter L Lindsay, Jr.
*Assistant Examiner* — Rodney Bonnette
(74) *Attorney, Agent, or Firm* — Fildes & Outland, P.C.

(57) ABSTRACT

A cleaning device includes a cleaning blade member that has a tip abutting a surface of an image carrier so as to remove a residue remaining on the surface of the image carrier; an attaching member that includes a first attachment piece to which a base end of the cleaning blade member is attached, and a second attachment piece which is provided so as to intersect the first attachment piece at a predetermined angle; a housing member to which one of the first attachment piece and the second attachment piece is fixed at both ends along a longitudinal direction thereof; and an external force exerting member that exerts an external force in a direction which intersects a surface of the other one of the first attachment piece and the second attachment piece, which is not fixed to the housing member.

16 Claims, 15 Drawing Sheets

CLEANING DEVICE AND IMAGE FORMING APPARATUS USING THE SAME

CROSS-REFERENCE TO RELATED APPLICATIONS

This application is based on and claims priority under 35 USC 119 from Japanese Patent Application Nos. 2009-077548 and 2009-077549, both filed on Mar. 26, 2009.

BACKGROUND

Technical Field

The present invention relates to a cleaning device, and an image forming apparatus using the same.

SUMMARY

According to an aspect of the invention, there is provided a cleaning device including a cleaning blade member that has a tip abutting a surface of an image carrier so as to remove a residue remaining on the surface of the image carrier; an attaching member that includes a first attachment piece to which a base end of the cleaning blade member is attached, and a second attachment piece which is provided so as to intersect the first attachment piece at a predetermined angle; a housing member to which one of the first attachment piece and the second attachment piece is fixed at both ends along a longitudinal direction thereof; and an external force exerting member that exerts an external force in a direction which intersects a surface of the other one of the first attachment piece and the second attachment piece, which is not fixed to the housing member.

BRIEF DESCRIPTION OF THE DRAWINGS

Exemplary embodiment(s) of the present invention will be described in detail based on the following figures, wherein:

FIG. 22 is a configuration diagram showing chief parts of a cleaning device according to an exemplary embodiment D1 of this invention, wherein

16 denotes PHOTOSENSITIVE DRUM, 19 denotes CLEANING DEVICE, 50 denotes CLEANING BLADE, 60 denotes ATTACHING MEMBER, 61 denotes FIRST ATTACHMENT PIECE, 62 denotes SECOND ATTACHMENT PIECE, and 65 and 68 denote URETHANE SPONGE (SHOCK ABSORBING MATERIAL).

DETAILED DESCRIPTION

Hereinafter, exemplary embodiments of the invention will be described with reference to the drawings.

Figure 2:
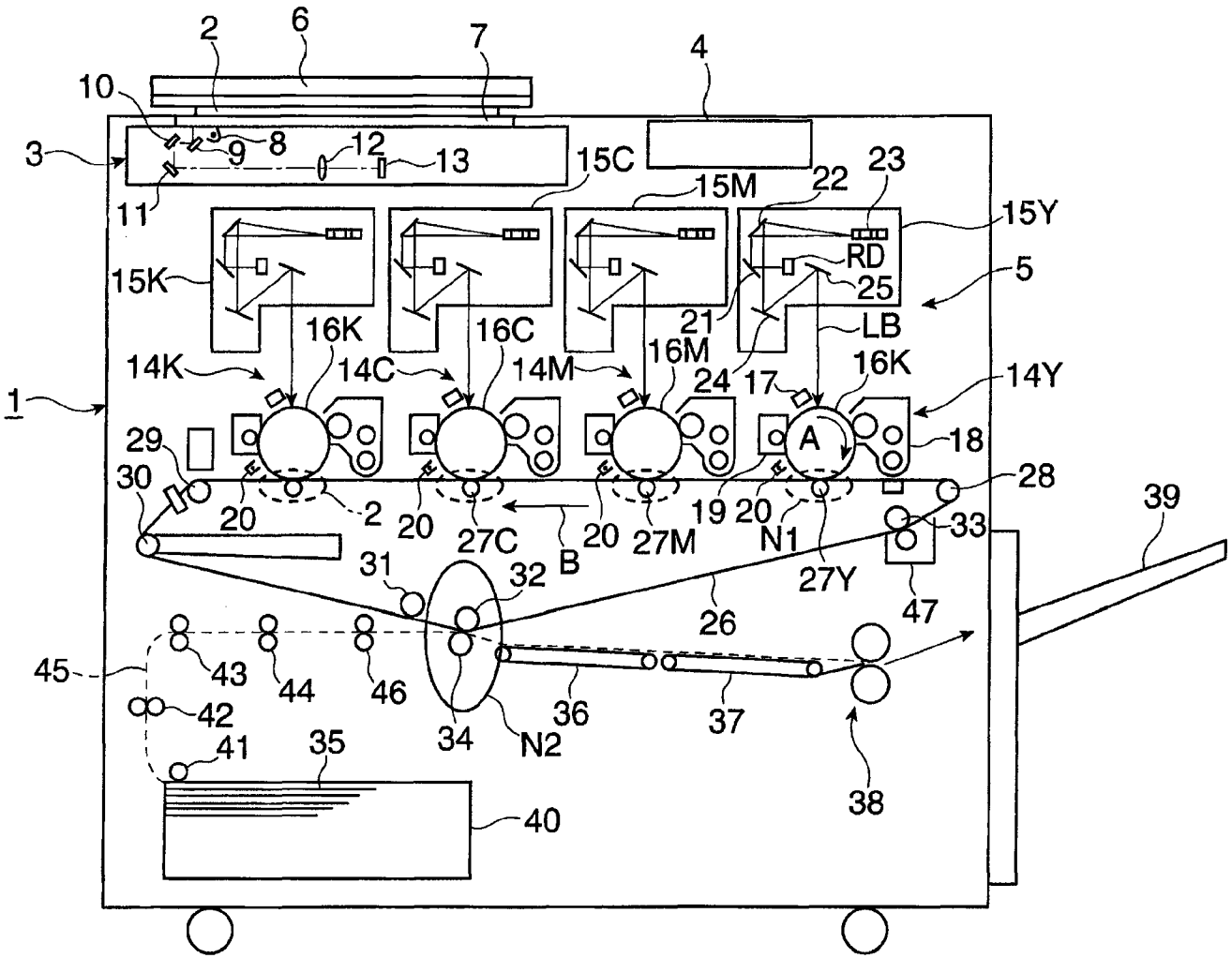
FIG. 2 is a configuration diagram showing a tandem digital color printer as an image forming apparatus to which the cleaning device according to the exemplary embodiment of this invention is applied.

FIG. 2 is a schematic configuration diagram showing a tandem digital color printer as an image forming apparatus to which a cleaning device according to an exemplary embodiment of this invention is applied. Further, the tandem digital color printer includes an image reader, and also functions as a full color copying machine or a facsimile. In addition, the above image forming apparatus may be an apparatus which does not include an image reader, and forms an image on the basis of the image data output from a personal computer which is not shown.

In FIG. 2, reference numeral 1 represents a main body of the tandem digital color printer, and the main body 1 of the digital color printer includes an image reader 3 which reads the image of a document 2 in an upper portion on one side (left side in the illustrated example) thereof. Further, an image processor 4, which performs predetermined image processing on the image data output from the image reader 3 or a personal computer (not shown) etc., or the image data delivered via a telephone line or LAN etc., is disposed inside the above main body 1 of the color printer, and an image output device 5, which outputs an image on the basis of the image data subjected to predetermined image processing by the image processor 4, is disposed inside the main body 1 of the digital color printer.

The above image reader 3 is configured so as to open and close a platen cover 6 to thereby place the document 2 on a platen glass 7 and illuminate the document 2 placed on the platen glass 7 by a light source 8, and so as to scan and expose a reflected light image from the document 2 onto an image reading element 13 composed of a CCD or the like via a reduction ratio optical imaging system composed of a full rate mirror 9, half rate mirrors 10 and 11, and an imaging lens 12, to thereby read the image of the document 2 in a predetermined dot density by the image reading element 13.

The image of the document 2 read by the above image reader 3 is delivered to the image processor 4 as, for example, document reflectance data of three colors of red (R), green (G), and blue (B) (for example, 8 bits for each color). In the image processor 4, predetermined image processing, such as shading correction, positional deviation correction, lightness/color space conversion, gamma correction, edge erase, and color/movement edition, is performed on the reflectance data of the document 2.

The image data which has been subjected to predetermined image processing in the image processor 4 as described above is converted into image data of four colors of yellow (Y), magenta (M), cyan (C), and black (K), similarly by the image processor 4, and delivered to image exposure devices 15Y, 15M, 15C, and 15K of image forming units 14Y, 14M, 14C, and 14K for the individual colors of yellow (Y), magenta (M), cyan (C), and black (K). In three image exposure devices 15Y, 15M, 15C, and 15K, image exposure by a laser beam is performed according to the corresponding color image data.

Meanwhile, as described above, the four image forming units 14Y, 14M, 14C, and 14K for yellow (Y), magenta (M), cyan (C), and black (K) are disposed in parallel at regular intervals in a horizontal direction inside the main body 1 of the above tandem digital color printer.

All the four image forming units 14Y, 14M, 14C, and 14K, as shown in a FIG. 2, are similarly configured except for the colors used to form an image, and mainly includes a photosensitive drum 16 serving as an image carrier which is rotationally driven at a predetermined speed in the direction of an arrow A, a scorotron 17 for primary charging which uniformly charges the surface of the photosensitive drum 16, an image exposure device 15 serving as an image input unit which performs image exposure on the surface of the photosensitive drum 16 on the basis of the image data corresponding to each color so as to form an electrostatic latent image, a developing device 18 which develops the electrostatic latent image formed on the photosensitive drum 16 with toner, a cleaning device 19 which cleans the toner which has remained on the surface of the photosensitive drum 16, and a pre-cleaning corotron 20.

As shown in FIG. 2, the above image exposure device 15 modulates a semiconductor laser LD according to the image data of a corresponding color output from the image processor 4, and emits a laser beam LB according to the image data from the semiconductor laser LD. The laser beam LB emitted from the semiconductor laser LD is radiated onto the surface of a rotary polygon mirror 23 via mirrors 21 and 22 or the like, is deflected and scanned by the rotary polygon mirror 23, and then, is scanned and exposed onto the photosensitive drum 16 along an f-θ lens (not shown), reflecting mirrors 22, 24, and 25 etc. in a rotational axis direction (fast scanning direction).

As shown in FIG. 2, image data of the corresponding colors is sequentially output to the image exposure devices 15Y, 15M, 15C, and 15K of the image forming units 14Y, 14M, 14C, and 14K for individual colors of yellow (Y), magenta (M), cyan (C), and black (K) from the above image processor 4, and laser beams LB emitted according to image data from the image exposure devices 15Y, 15M, 15C, and 15K are scanned and exposed onto the surfaces of the corresponding photosensitive drums 16Y, 16M, 16C, and 16K, thereby forming electrostatic latent images. The electrostatic latent images formed on the surfaces of the above photosensitive drums 16Y, 16M, 16C, and 16K are respectively developed by the developing devices 18Y, 18M, 18C, and 18K, as toner images of individual colors of yellow (Y), magenta (M), cyan (C), and black (K).

The toner images of individual colors of yellow (Y), magenta (M), cyan (C), and black (K) sequentially formed on the photosensitive drums 16Y, 16M, 16C, and 16K of the above image forming units 14Y, 14M, 14C, and 14K, as shown in FIG. 2, are multiple-transferred onto an intermediate transfer belt 26 serving as an endless belt-like intermediate transfer body, which is disposed below the image forming units 14Y, 14M, 14C, and 14K, by primary transfer rolls 27Y, 27M, 27C, and 27K in a primary transfer position N1. The intermediate transfer belt 26 is hung over a drive roll 28, a tensioning roll 29, a meandering control roll 30, a driven roll 31, a back supporting roll 32, and a driven roll 33 with a constant tension, and is driven in an circulating manner at a predetermined traveling speed in the direction of an arrow B by the drive roll 28 which is rotationally driven by an exclusive driving motor (not shown) having excellent constant-speed properties. As the above intermediate transfer belt 26, for example, an intermediate transfer belt is used which is formed in an endless belt shape from synthetic resin film, such as polyimide or polyamidoimide having flexibility.

The toner images of individual colors of yellow (Y), magenta (M), cyan (C), and black (K) multiple-transferred onto the above intermediate transfer belt 26 are secondarily transferred onto a recording sheet 35 serving as a recording medium by a pressure contact force and an electrostatic force in a secondary transfer position N2 by a grounded secondary transfer roller 34 to which a transfer voltage having a polarity (positive polarity) opposite to that of the toner is applied by the back supporting roll 32 and which is brought into pressure contact with the back supporting roll 32, and the recording sheet 35 to which toner images according to colors of an image to form have been transferred is conveyed to a fixing device 38 by double conveyor belts 36 and 37. The recording sheet 35 onto which the above toner images of individual colors have been transferred undergoes fixing treatment by using heat and pressure by the fixing device 38, and is ejected onto an ejection tray 39 provided outside the main body 1 of the printer.

As shown in FIG. 2, the above recording sheet 35, which is a sheet of the desired size and material from a sheet feed tray 40 disposed at the bottom of the main body 1 of the printer, is fed in the state of being separated one by one by a sheet feed roll 41 and a pair of sheet separating rolls (not shown), and is conveyed to a registration roll 46 via a sheet conveying path 45 where a plurality of conveying rolls 42, 43, and 44 are disposed. The recording sheet 35 supplied from the above sheet feed tray 40 is delivered to the secondary transfer position N2 of the intermediate transfer belt 26 by the registration roll 46 which is rotationally driven with predetermined timing. In addition, although one sheet feed tray 40 is shown, a plurality of sheet feed trays, including recording sheets 35 of mutually different sizes or the same size, may be provided, and a number of recording sheets 35 can be continuously fed from the sheet feed tray 40.

Prior to this, in the above four image forming units 14Y, 14M, 14C, and 14K for yellow, magenta, cyan and black, as described above, individual toner images of yellow, magenta, cyan, and black are sequentially formed with predetermined timing.

Meanwhile, the above photosensitive drums 16Y, 16M, 16C, and 16K are neutralized by the pre-cleaning corotron 20 after the transfer process of the toner images is completed, and then, residual toner or the like is removed by the cleaning devices 19Y, 19M, 19C, and 19K, thereby providing the next image forming process. Further, in the intermediate transfer belt 26, residual toner, paper debris etc. are removed by a cleaner 47 using a belt which disposed so as to face the driven roll 33.

Figure 3:
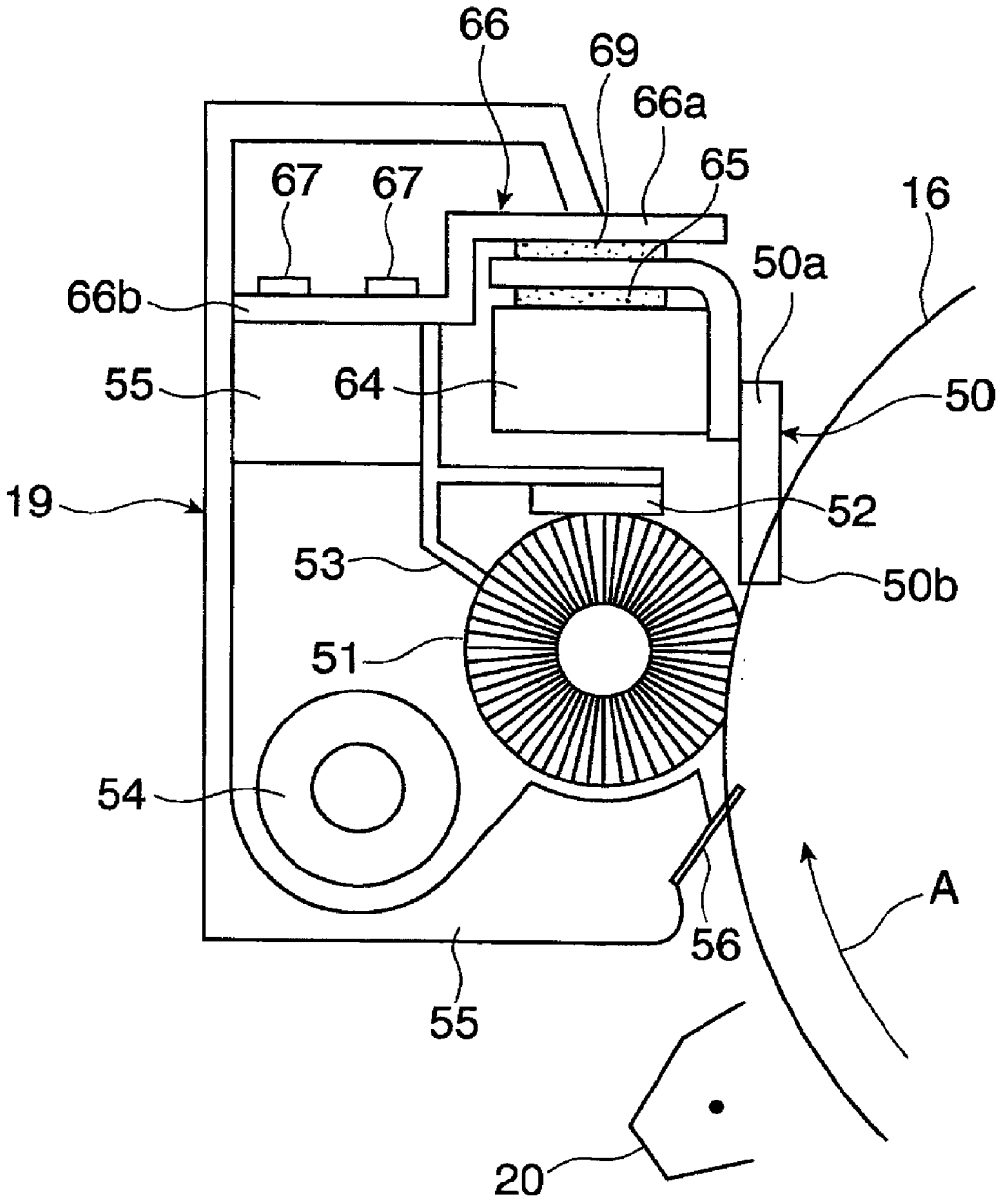
FIG. 3 is a configuration diagram showing the cleaning device according to the exemplary embodiment A1 of this invention.

FIG. 3 is a configuration diagram showing a cleaning device used for the digital color printer configured as above.

The cleaning device 19, as shown in FIG. 3, includes a cleaning blade 50 which abuts the surface of the photosensitive drum 16, an application brush 51 which applies lubricant to the surface of the photosensitive drum 16, lubricant 52 composed of solids, such as zinc stearate (ZnSt), which abuts the surface of the application brush 51, a flicker bar 53 which abuts the surface of the application brush 51 so as to scrape down unnecessary lubricant 52, thereby adjusting the amount of supply of the lubricant 52 to the surface of the photosensitive drum 16, and a discharge auger 54 which is rotationally driven with predetermined timing so as to discharge the toner removed by the cleaning blade 50 to the outside.

Further, in the above cleaning device 19, as shown in FIG. 3, a sealing member 56 seals the space between the photosensitive drum 16 and a cleaning device housing 55 on the upstream side in the rotational direction of the photosensitive drum 16.

Figure 4:
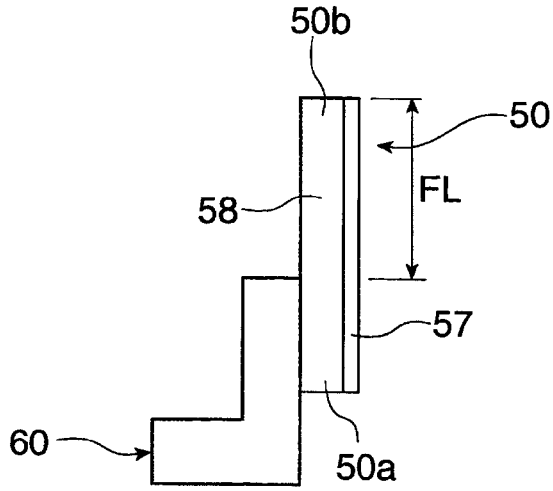
FIG. 4 is a configuration diagram showing the attaching state of a cleaning blade.

As the above cleaning blade 50, for example, as shown in FIG. 4, the cleaning blade of a two-layer structure is used in which a cleaning layer 57 and a back supporting layer 58, which are made of urethane rubber having different physical properties, are laminated. The above cleaning blade 50 has a base end 50*a* anchored by a means such as bonding to an attaching member 60 made of a sheet metal bent to have an L-shaped cross-section.

Figure 5:
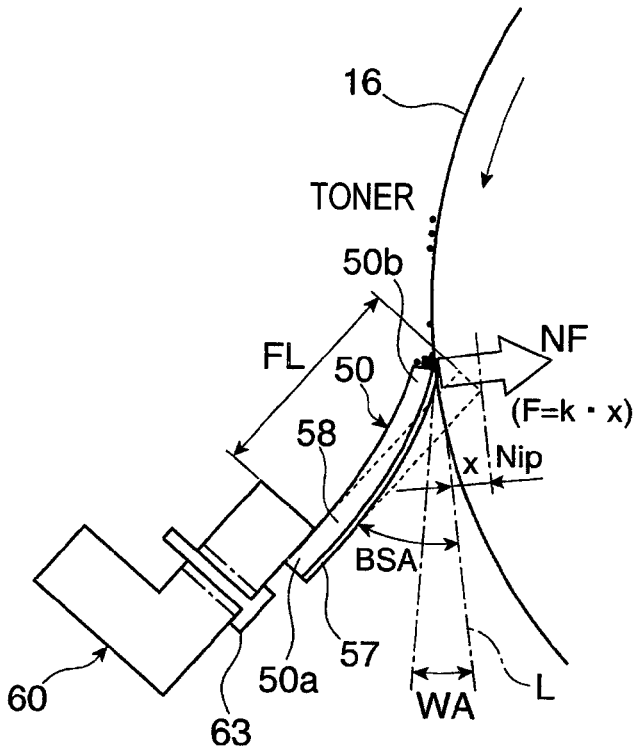
FIG. 5 is a configuration diagram showing the setting state of the cleaning blade.

Further, the above cleaning blade 50, as shown in FIG. 5, has the base end 50*a* located on the downstream side in the rotational direction of the photosensitive drum 16 with respect to the surface of the photosensitive drum 16 as the member to be cleaned, and has a front end 50*b* located on the upstream side in the rotational direction of the photosensitive drum 16, and serves as a so-called "doctor blade" which abuts the surface of the photosensitive drum 16 from a direction opposite to the rotational direction of the photosensitive drum.

Moreover, in the above cleaning blade 50, as shown in FIG. 5, the length before deformation of a tip side portion excluding the base end 50*a* anchored to the attaching member 60 is referred to as a free length (FL), the angle formed between the base end 50*a* of the cleaning blade 50 and a tangential line L at a contact point of the surface of the photosensitive drum 16 where the front end 50*b* of the cleaning blade 50 contacts is referred to as a blade setting angle (BSA), and the angle formed between the front end 50*b* of the cleaning blade 50 and the tangential line L is referred to as a wrap angle (WA). Further, when the above cleaning blade 50 is fixed to an attachment position and the photosensitive drum 16 is removed, the distance between the front end 50*b* of the cleaning blade 50 which extends linearly and the tangential line L is referred to as a nip distance (x), and a nip force (NF) with which the cleaning blade 50 abuts the surface of the photosensitive drum 16 can be expressed as $F=k\cdot X$. Here, k is a constant unique to a blade.

The free length (FL), blade setting angle (BSA), wrap angle (WA), nip distance (x), and nip force (NF) are parameters which determine the characteristics of the cleaning blade 50.

Figure 6:
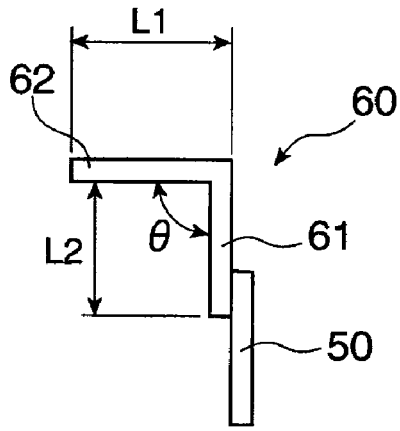
FIG. 6 is a configuration diagram showing an attaching member.

The above attaching member 60, as shown in FIG. 6, is composed of a first attachment piece 61 to which the cleaning blade 50 is anchored, and a second attachment piece 62 which is bent so as to intersect the first attachment piece 61 at an angle of about 90°. Here, the length of the above second attachment piece 62 is defined as L1 including the sheet thickness of the attaching member 60, and the length of the first attachment piece 61 is defined as L2 except for the sheet thickness of the attaching member 60.

Exemplary Embodiment A1

Figure 1A:
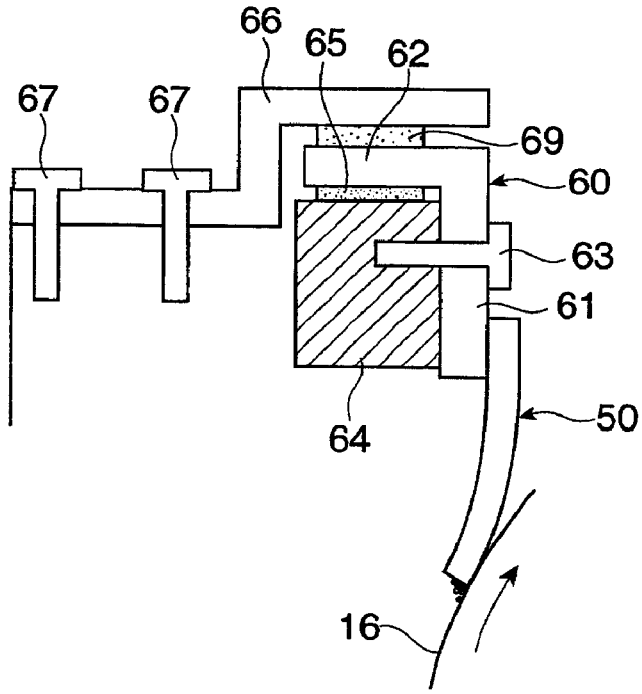
FIGS. 1A and 1B are a configuration diagram showing chief parts of a cleaning device according to an exemplary embodiment A1 of this invention.
Figure 1B:
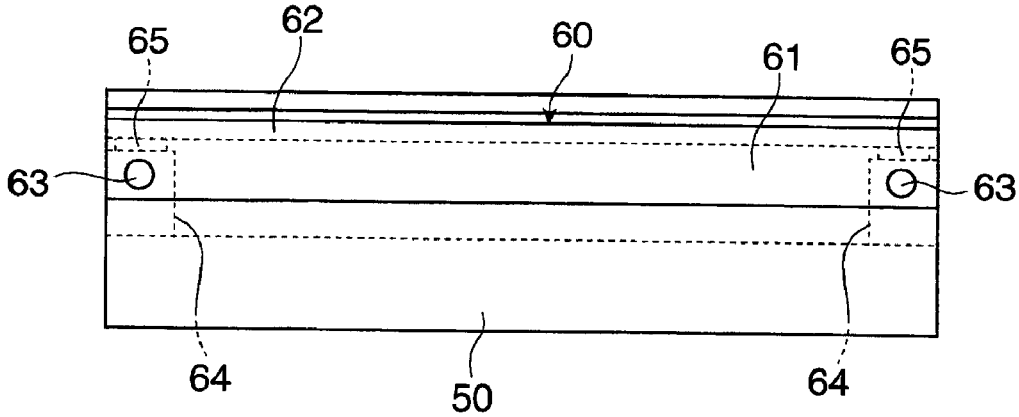

FIGS. 1A and 1B show an exemplary embodiment A1 of the invention. The above attaching member 60, as shown in FIGS. 1A and 1B, is attached in a state where both ends along the longitudinal direction of the first attachment piece 61 thereof are fastened by a fixing screw 63 on a side surface of the cleaning device housing 64, which is formed to have a rectangular cross-section.

Figure 7:
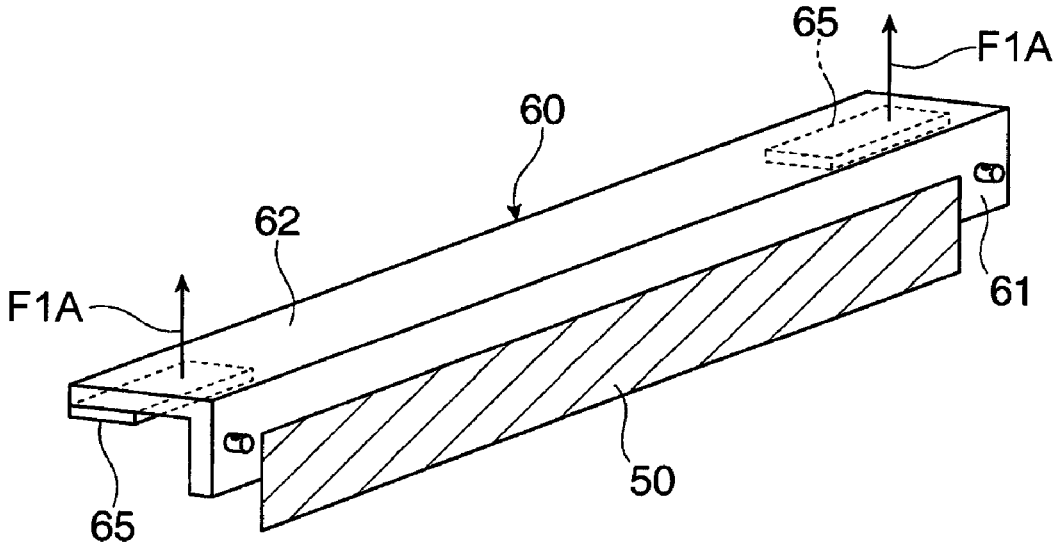
FIG. 7 is a configuration diagram according to the exemplary embodiment A1 of this invention showing the force applied to the attaching member from a shock absorbing material.

In this exemplary embodiment A1, as shown in FIGS. 1A and 1B, the urethane sponge 65 serving as a shock absorbing material with a thickness of 3 mm or 5 mm is interposed in a compressed state between the second attachment piece 62 which is not fixed to the cleaning device housing 64 of the attaching member 60, and the upper end surface of the cleaning device housing 64, so that each sponge has a thickness of 0.25 mm, and the second attachment piece 62 of the attaching member 60, as shown in FIG. 7, is configured so that an elastic repulsive force F1A serving as an external force acts upward on the bottom surface of the second attachment piece 62. The portion in which this urethane sponge 65 is provided becomes an external force exerting portion.

The above urethane sponge 65 is formed in a rectangular shape with a width of 8 mm to 10 mm and a length of 15 mm, and is interposed in a compressed state between the bottom surface of the second attachment piece 62 in a position corresponding to the fastening position of the attaching member 60, and the upper end surface of the cleaning device housing 64. The urethane sponge 65 generates the elastic repulsive force of about 640 gf when a sponge with a thickness of 5 mm is compressed so as to have a thickness of 0.25 mm.

In addition, in FIGS. 1 and 3, reference numeral 66 represents a flicker cover, reference numeral 67 represents a fixing screw which fixes the flicker cover 66, and reference numeral 69 represents a sealing member which also prevents leakage of the toner.

Figure 8:
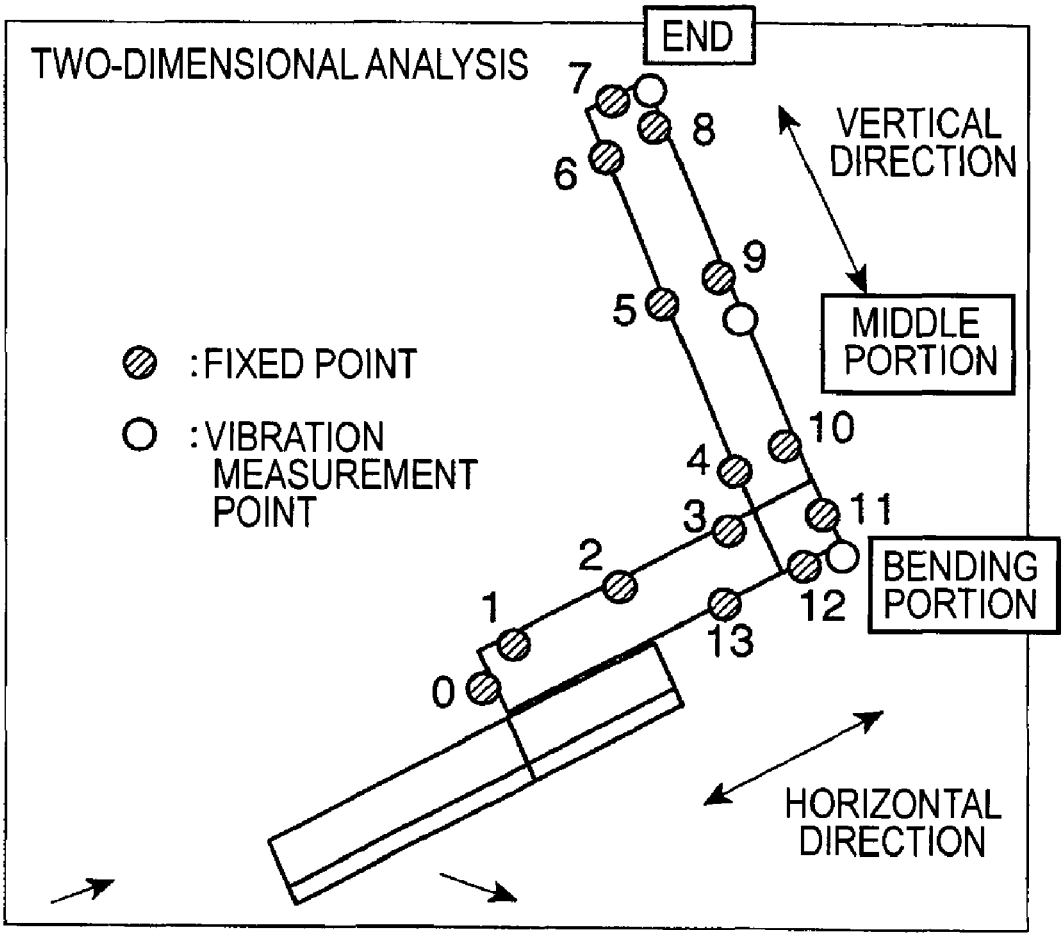
FIG. 8 is an explanatory view showing a numerical analysis method of the vibrational state of the attaching member.

Further, in order for the present inventors to confirm how much a pressing force is needed to be generated by the urethane sponge 65, as shown in FIG. 8, when various positions of the attaching member 60 are fixed in the two-dimensional cross-section of the attaching member 60, the size of the amplitudes in the horizontal and vertical directions and the reaction forces of fixed points generated in individual positions of the end, middle portion, and bending portion of the second attachment piece 62 of the attaching member 60 are obtained from the numerical analysis.

Figure 9A:
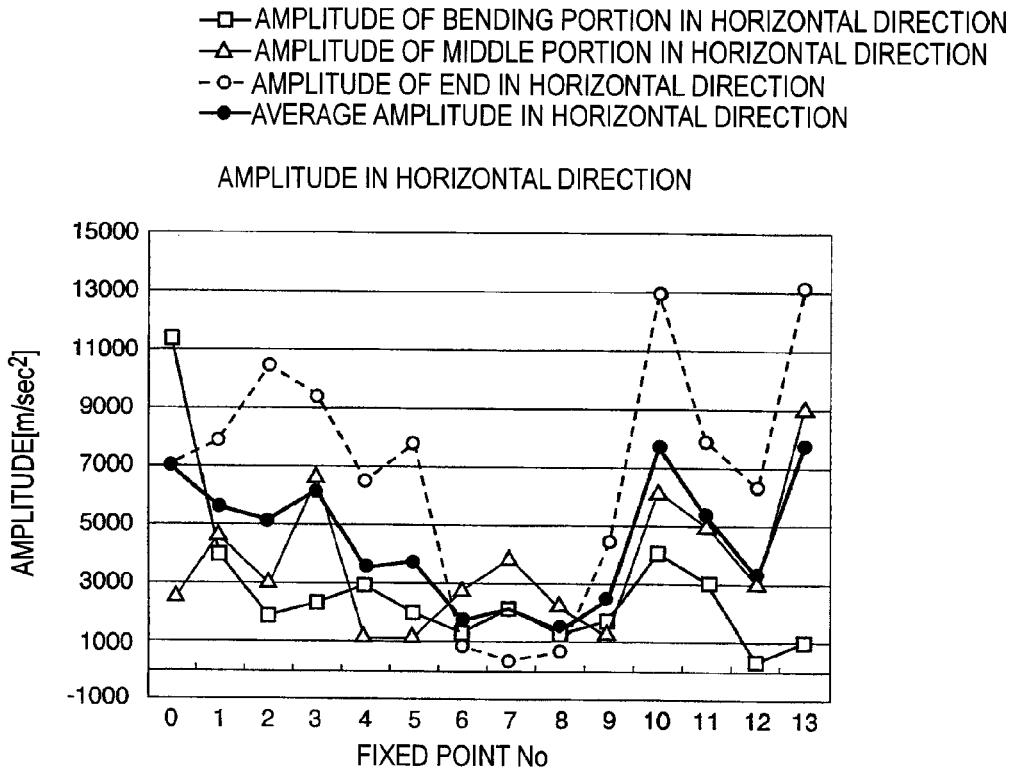
FIGS. 9A and 9B are a graph showing numerical analysis results of the vibrational state of the attaching member.
Figure 9B:
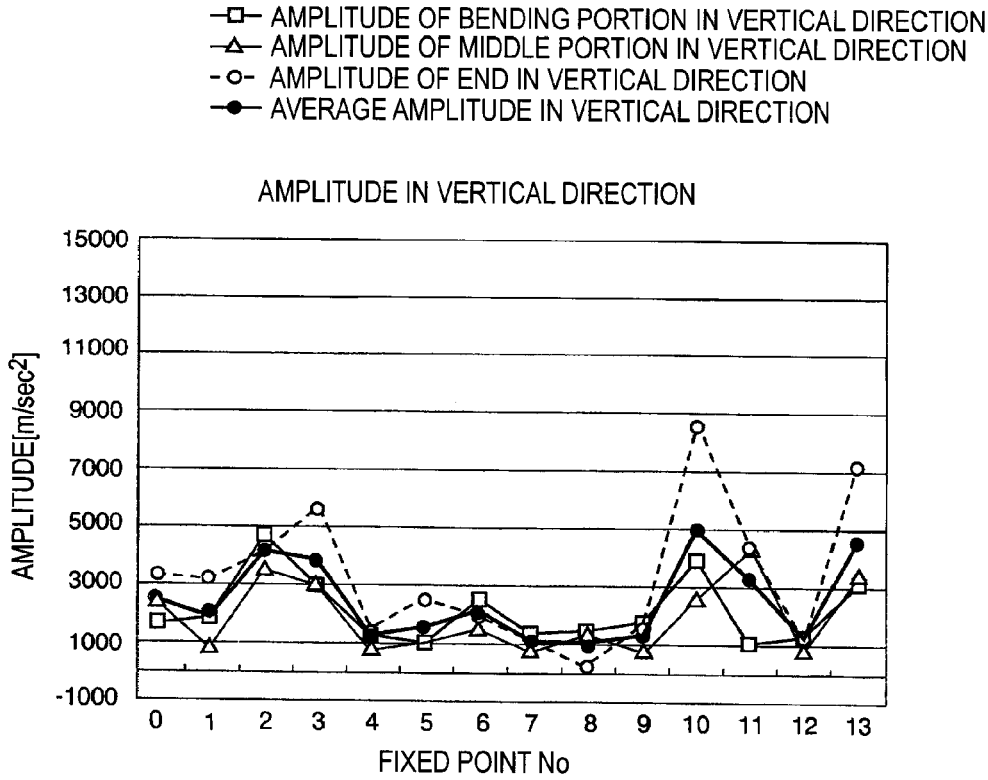
Figure 10:
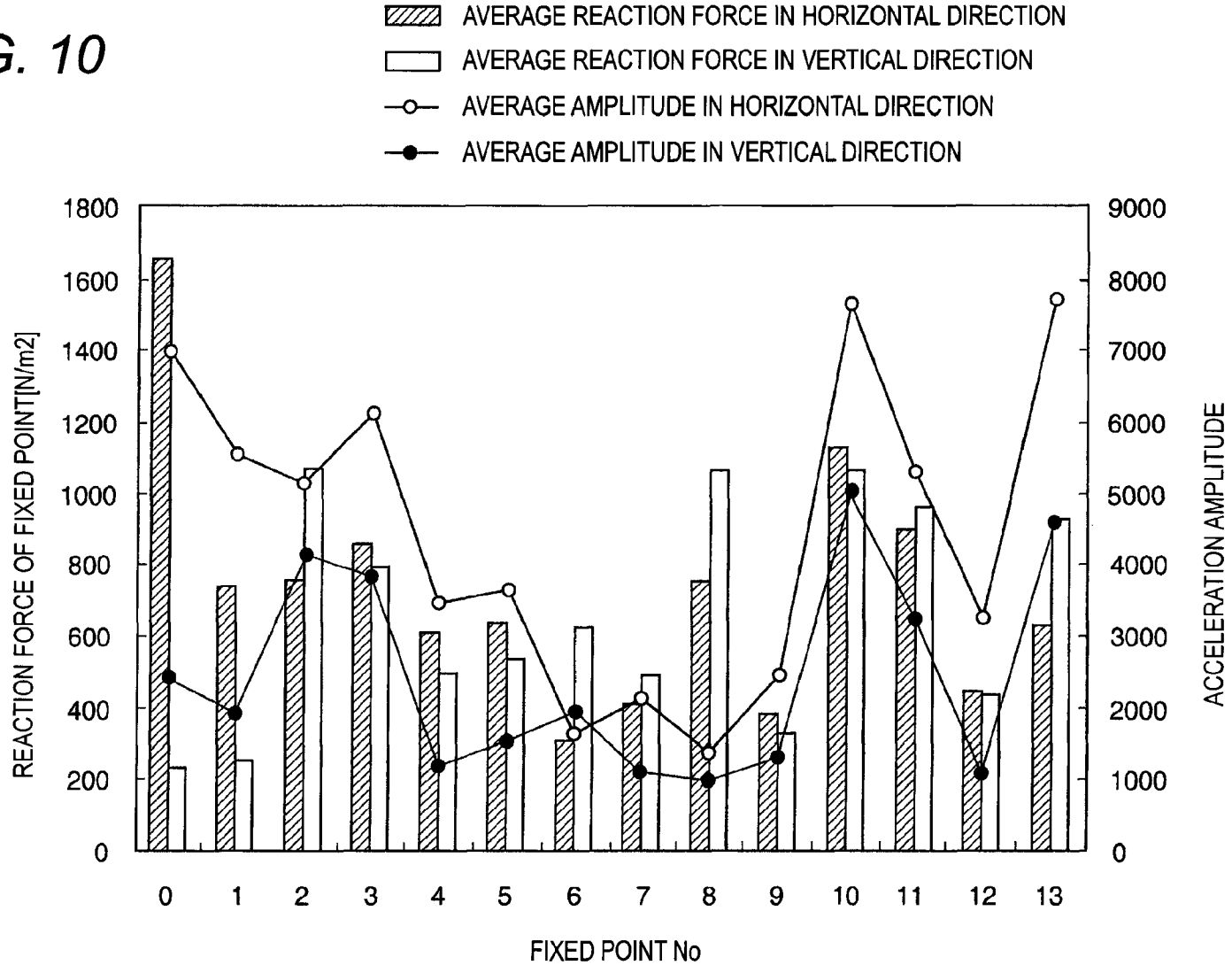
FIG. 10 is a graph showing numerical analysis results of the vibrational state of the attaching member.

FIGS. 9 and 10 each show results of the above numerical analysis.

First, as is clear from the results of the above numerical analysis, it is found that the amplitude of the vibration in the vertical direction which intersects the surface of the cleaning blade 50, as shown in FIGS. 9A and 9B, is significantly smaller than the amplitude of the vibration in the horizontal direction along the surface of the cleaning blade 50.

Accordingly, in the second attachment piece 62 of the attaching member 60, it is important to suppress the vibration in the direction which intersects the surface of the second attachment piece 62 at an angle of about 90° by some means or another. In that case, since the first attachment piece 61 of the above attaching member 60 has both longitudinal ends fixed to the cleaning device housing 64 with the fixing screw 63, the vibration is already suppressed to some extent.

Second, even in the amplitude in the same horizontal direction, as shown in FIG. 10, it can be understood that it is desirable that the reaction forces of fixed points Nos. 6 to 9 near the midpoint of the second attachment piece 62 are small.

Experimental Example A1

The present inventors carried out experiments producing an off-line bench model of the digital color printer as shown in FIG. 2, applying an alternating voltage of 1.5 kVp-p, and an electric current of about 750 μA to the application brush 51 of the cleaning device 19 in the environment with a temperature of 10° C. and a relative humidity of 15% RH in a state which the developing device and the charging device are removed, supplying zinc stearate (ZnSt) to the surface of the photosensitive drum 16, and measuring the sound pressure of the vibration sound generated near the cleaning blade 50 in the cleaning blade 50 in conditions where more stress is applied.

In addition, a two-layer structured cleaning blade is used as the cleaning blade 50.

Figure 11:
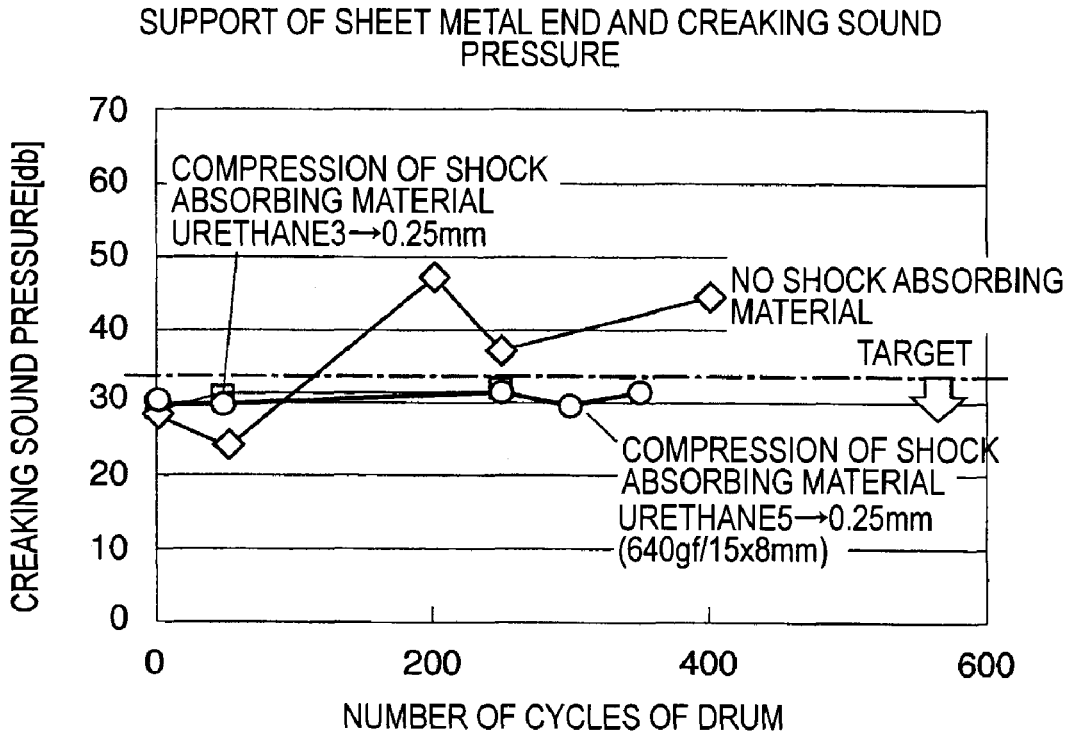
FIG. 11 is a graph showing experimental results of an experimental example A1 of this invention.

FIG. 11 shows the results of the above experimental example.

As is clear from this graph, when an urethane sponge with a thickness of 5 mm is used after being compressed to a thickness of 0.25 mm as the shock absorbing material 65 according to this exemplary embodiment, and the external force F1A of 792 gf is exerted thereon, it is found that the sound pressure of the vibration sound (frequency of 700 to 900 Hz) generated in the cleaning blade 50 can be suppressed to 35 (dB) which is the target level. In addition, even when an urethane sponge with a thickness of 2 mm as the shock absorbing material is used after being compressed to a thickness of 0.25 mm, substantially the same results can be obtained.

On the other hand, when the shock absorbing material according to this exemplary embodiment is not used, the sound pressure of the vibration sound generated in the cleaning blade 50 exceeds 35 (dB), which is the target level, if the number of cycles of the photosensitive drum 16 exceeds 200 cycles, and the vibration sound generated in the cleaning blade 50 becomes harsh on the ear.

Experimental Example A2

Figure 12:
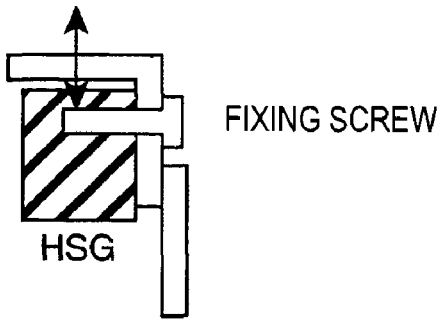
FIG. 12 is an explanatory view showing a measuring method of the vibrational state of the attaching member.

Further, in order to investigate the vibrational state of the attaching member 60 when the shock absorbing material according to this exemplary embodiment is not used under the same conditions as the experimental example A1, the present inventors, as shown in FIG. 12, has carried out the experiment by attaching an acceleration pickup which measures the acceleration of the surface of the second attachment piece 62 of the attaching member 60, and measuring the acceleration in a direction vertical to the surface of the second attachment piece 62 in three places including both ends and a middle portion of the second attachment piece 62 in its longitudinal direction.

Figure 13:
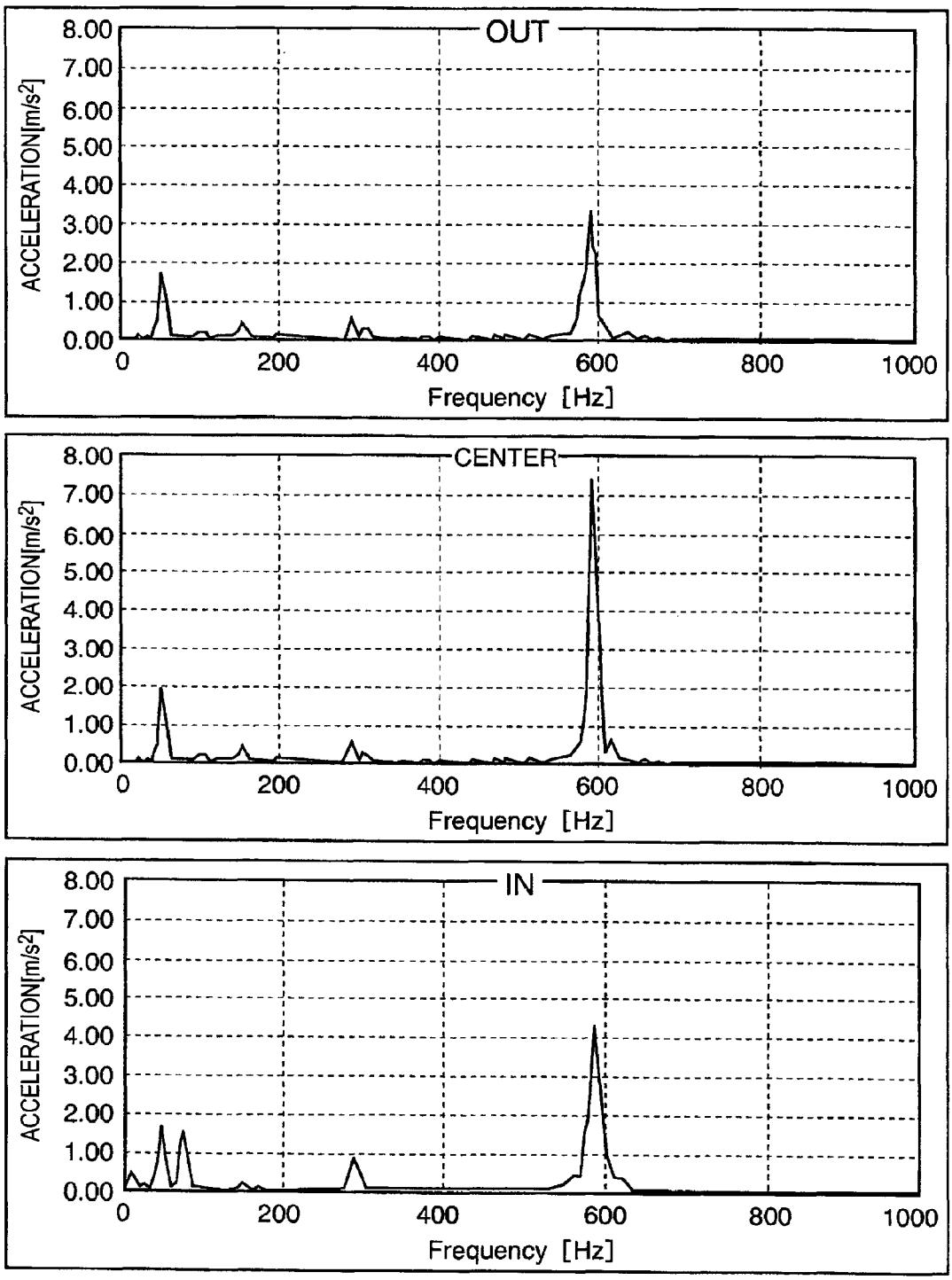
FIG. 13 is a graph showing measurement results of the vibrational state of the attaching member.
Figure 14:
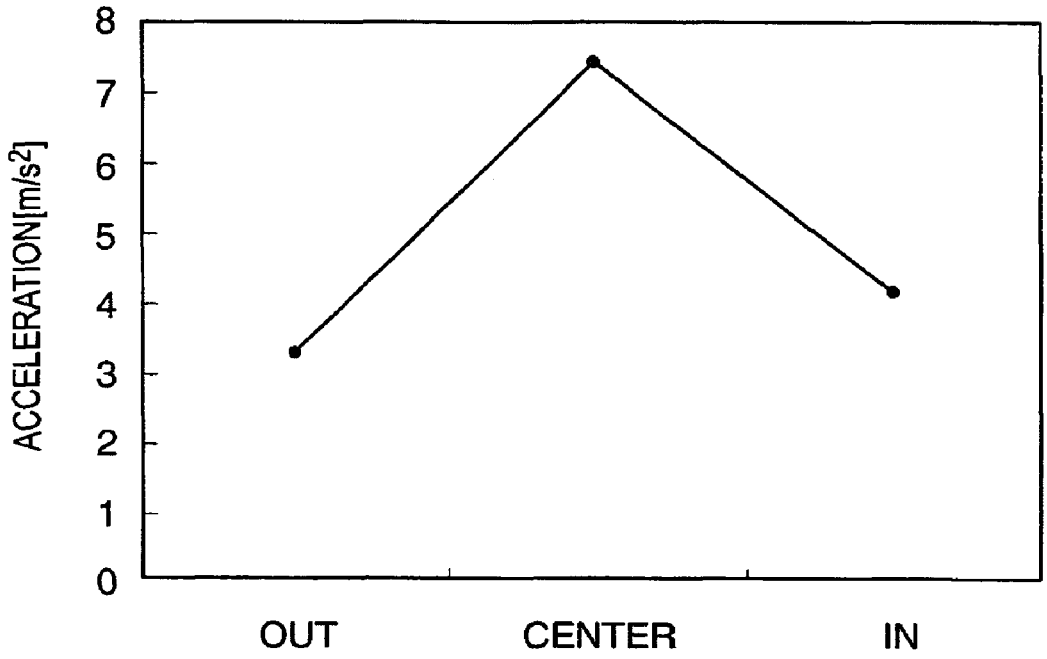
FIG. 14 is a graph showing measurement results of the vibrational state of the attaching member.

FIGS. 13 and 14 show results of the above experimental example.

As is clear from this graph, the acceleration in the direction vertical to the surface of the second attachment piece 62 in three places including both ends and middle portion of the surface of the second attachment piece 62 in its longitudinal direction is the largest at the middle portion in the longitudinal direction, and it is possible to suppress the sound pressure of the vibration sound generated in the cleaning blade 50 to 35 (dB) or less, which is the target level, by using the shock absorbing material 65 according to this exemplary embodiment, thereby suppressing the middle portion of the attaching member 60 in its longitudinal direction by the external force F1A.

Exemplary Embodiment A2

Figure 15:
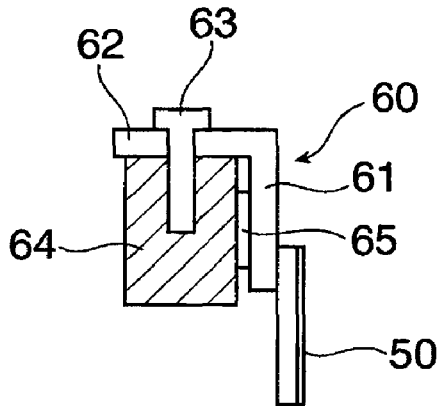
FIG. 15 is a configuration diagram showing chief parts of a cleaning device according to an exemplary embodiment A2 of this invention.

FIG. 15 shows an exemplary embodiment A2 of this invention. When description is made with the same reference numerals being given to the same portions as the exemplary embodiment A1, this exemplary embodiment A2 differs from the exemplary embodiment A1 in terms of the attaching structure of the attaching member holding the cleaning blade, and the position of the external force exerting portion.

That is, in this exemplary embodiment A2, as shown in FIG. 15, the attaching member 60 holding the cleaning blade 50 is attached in a state where the first attachment piece 61 is not attached to the cleaning device housing 64, and the second attachment piece 62, in which the cleaning blade 50 is not held, is fixed to the upper end surface of the cleaning device housing 64 by the fixing screw 63.

Further, in the first attachment piece 61 of the above attaching member 60, for example, the urethane sponge 65 with a thickness of 5 mm is interposed in a state of being compressed to a thickness of 0.25 mm between an internal surface opposite to the side where the cleaning blade 50 is held and the side surface of the cleaning device housing 64.

This exemplary embodiment A2 corresponds to a case where a fixed point is No. 9 in the numerical analysis shown in FIG. 8. In this case, as shown in FIGS. 9A and 9B, it is desirable since the amplitude in the vertical direction is small, and the amplitude in the horizontal direction is relatively small although the amplitude of the end is slightly large.

Since other configurations and operation are the same as those of the above exemplary embodiment A1, the description thereof is omitted.

Exemplary Embodiment B1

Figure 16A:
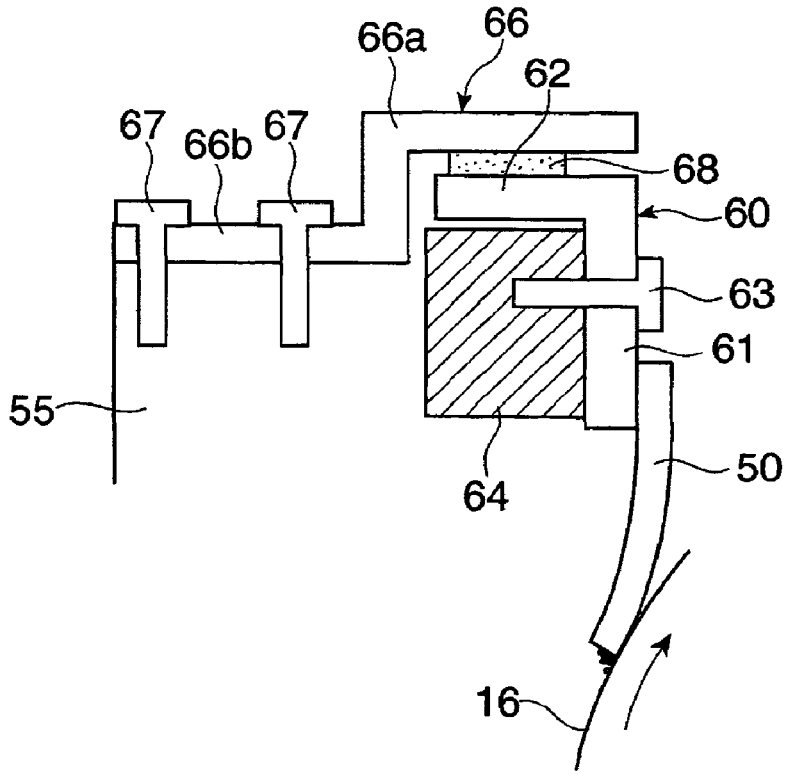
FIGS. 16A and 16B are a configuration diagram showing chief parts of a cleaning device according to an exemplary embodiment B1 of this invention.
Figure 16B:
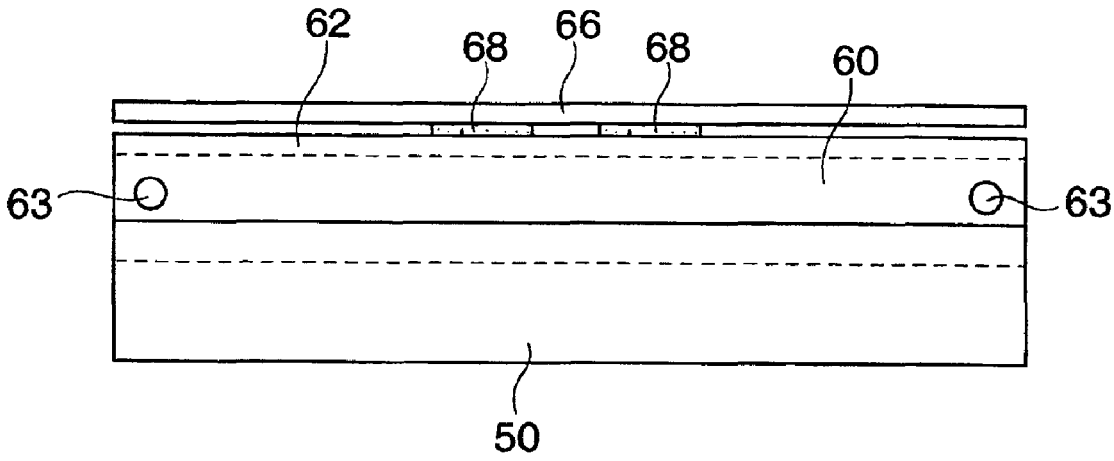

In addition, FIGS. 16A and 16B show an exemplary embodiment B1 of this invention, and description will be made with the same reference numerals being given to the same portions as the exemplary embodiment A1. The attaching member 60, as shown in FIGS. 16A and 16B, is attached in a state where both ends along the longitudinal direction of the first attachment piece 61 thereof are fastened by a fixing screw 63 to a side surface of the cleaning device housing 64, which is formed to have a rectangular cross-section.

Figure 17:
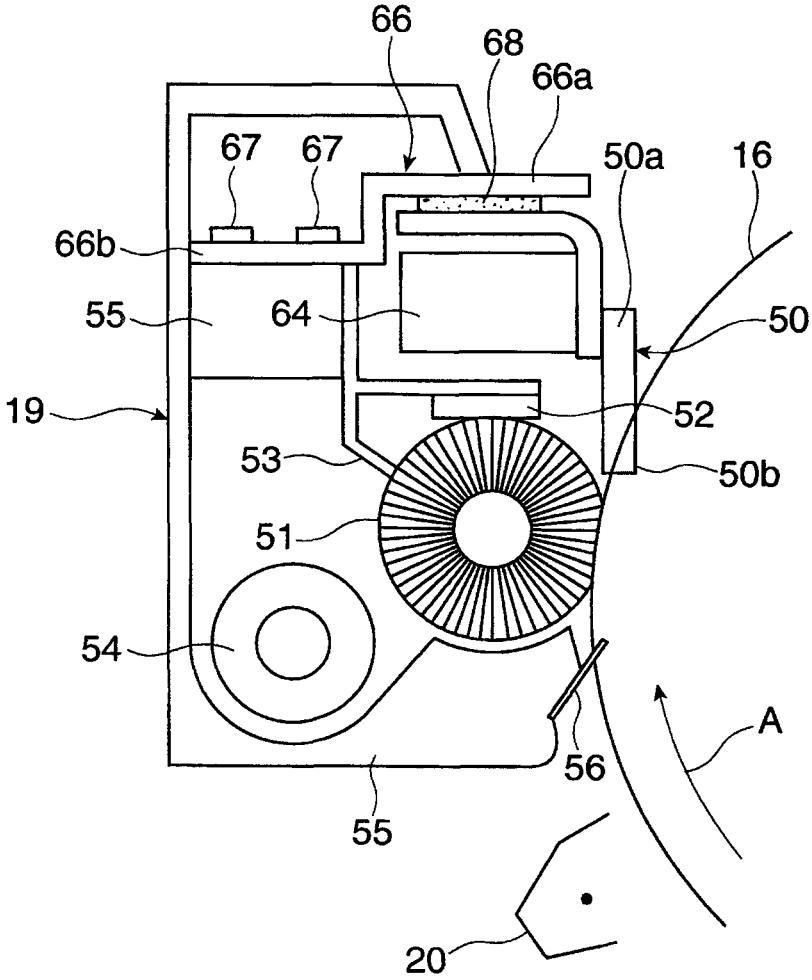
FIG. 17 is a configuration diagram showing the cleaning device according to the exemplary embodiment B1 of this invention.

Further, as shown in FIGS. 16 and 17, the flicker cover 66, which covers the space above the flicker bar 53, is attached to an upper portion of the attaching member 60 in the state of being fixed to the cleaning device housing 55 by a fixing screw 67. In the flicker cover 66, a portion 66*a* on the side of the attaching member 60 is relatively high, and is bent so that a portion 66*b* on the side of a fastened portion becomes relatively low.

Figure 18:
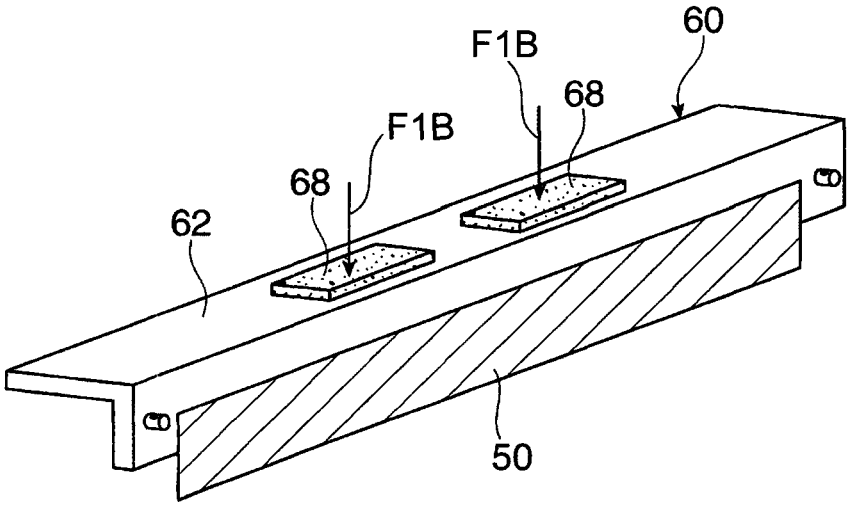
FIG. 18 is a configuration diagram according to the exemplary embodiment B1 of this invention showing the force applied to the attaching member from a shock absorbing material.

In this exemplary embodiment, as shown in FIGS. 16A and 16B, the urethane sponge 68 serving as a shock absorbing material with a thickness of 3 mm or 5 mm is interposed in a compressed state between the second attachment piece 62 which is not fixed to the cleaning device housing 64 (housing member) of the attaching member 60 and the lower end surface of the portion 66*a* of the flicker cover 66 on the side of the attaching member 60, so that each sponge has a thickness of 0.25 mm, and the second attachment piece 62 of the attaching member 60, as shown in FIG. 18, is configured so that an elastic repulsive force F1B serving as an external force acting downward on the top surface of the second attachment piece 62.

The above urethane sponge 68, as shown in FIG. 18, is formed in a long and thin rectangular shape with a width of 8 mm to 10 mm and a length of 50 mm, and is interposed in a compressed state between the top surface of the second attachment piece 62 in the middle portion of the attaching member 60 in its longitudinal direction and the lower end surface of the portion 66*a* of the flicker cover 66 on the side of the attaching member 60. When this urethane sponge 68 with a thickness of 5 mm is compressed to a thickness of 0.25 mm, the elastic repulsive force of about 792 gf is generated.

Further, the question on the required amount of pressing force generated by the urethane sponge 68 is considered in the same manner to the question on the required amount of pressing force generated by the urethane sponge 65 in the above exemplary embodiment A1.

Experimental Example B1

Similarly to the experimental example A1, the present inventors has carried out experiments producing an off-line bench model of the digital color printer as shown in FIG. 2, and determining the sound pressure of the vibration sound generated near the cleaning blade 50 in the cleaning blade 50 in the same conditions as the experimental example A1.

Figure 19:
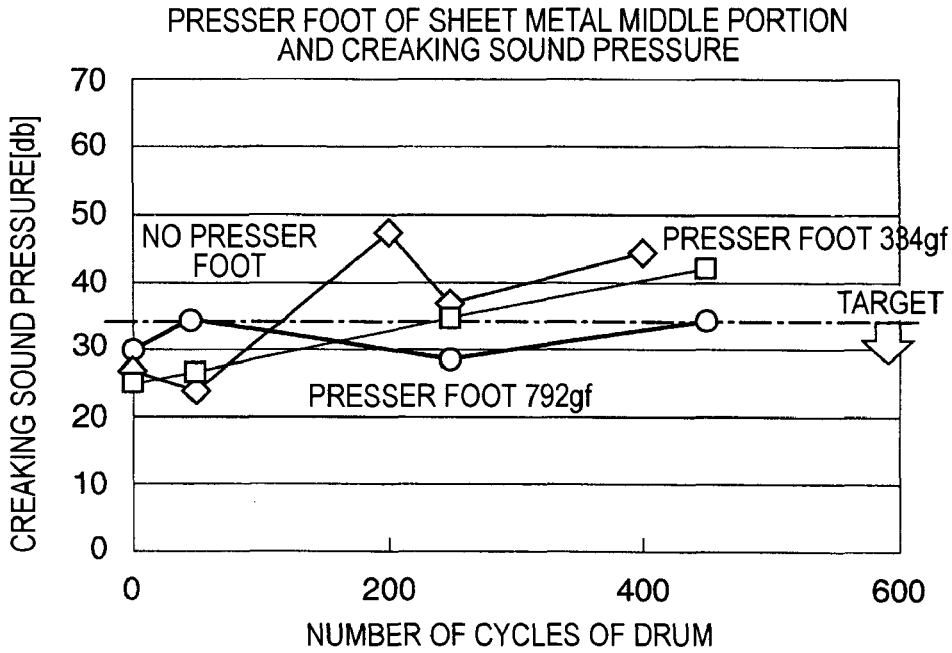
FIG. 19 is a graph showing experimental results of the experimental example B1 of this invention.

FIG. 19 shows the results of the above experimental example.

As is clear from this graph, when the shock absorbing material 68 according to this exemplary embodiment is used, or when an urethane sponge with a thickness of 5 mm is compressed to a thickness of 0.25 mm and the external force F1B of 792 gf is exerted thereon, it is found that the sound pressure of the vibration sound (frequency of 700 to 900 Hz) generated in the cleaning blade 50 can be suppressed to 35 (dB) or less which is the target level.

On the other hand, when the shock absorbing material according to this exemplary embodiment is not used, or when an urethane sponge with a thickness of 3 mm is compressed to a thickness of 0.25 mm and the external force F1B of 334 gf is exerted thereon, the sound pressure of the vibration sound generated in the cleaning blade 50 exceeds 35 (dB), which is the target level, if the number of cycles of the photosensitive drum 16 exceeds 200 cycles, and the vibration sound generated in the cleaning blade 50 becomes harsh on the ear.

Experimental Example B2 (=Experimental Example A2)

Further, in order to investigate the vibrational state of the attaching member 60 when the shock absorbing material according to this exemplary embodiment is not used, in the same conditions as the Experiment B1, it is only necessary to carry out the same experiment as the above experimental example A2.

As is clear from the graphs of FIGS. 13 and 14 which are the results of the above experimental example, the acceleration in a direction vertical to the surface of the second attachment piece 62 in three places including both ends and middle portion of the surface of the second attachment piece 62 in its longitudinal direction is the largest at the middle portion in the longitudinal direction, and it is possible to suppress the sound pressure of the vibration sound generated in the cleaning blade 50 to 35 (dB) or less, which is the target level, by using the shock absorbing material 68 according to this exemplary embodiment, thereby suppressing the middle portion of the attaching member 60 in its longitudinal direction by the external force F1B.

Exemplary Embodiment B2

Figure 20:
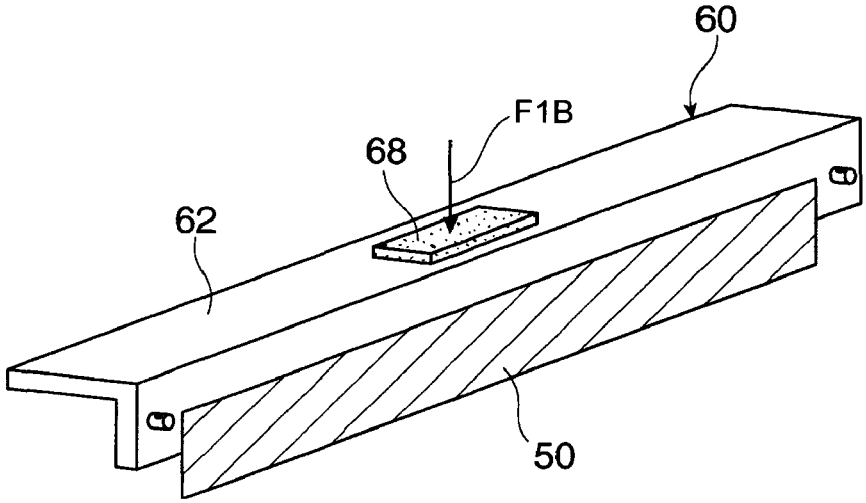
FIG. 20 is a configuration diagram showing chief parts of a cleaning device according to an exemplary embodiment B2 of this invention.

FIG. 20 shows an exemplary embodiment B2 of this invention. When description is made with the same reference numerals being given to the same portions as the exemplary embodiment B1, this exemplary embodiment B2 differs from the exemplary embodiment B1 in terms of the shape of the external force exerting member.

That is, in this exemplary embodiment B2, as shown in FIG. 20, only one urethane sponge 68 serving as an external force exerting member is provided along the longitudinal direction of the attaching member 60 on the upper end surface of the second attachment piece 62 of the attaching member 60.

Since other configurations and operation are the same as those of the above exemplary embodiment B1, the description thereof is omitted.

In addition, this invention uses the urethane sponge as the shock absorbing material as can be understood from the above exemplary embodiments. However, this urethane sponge does not only the function as an shock absorbing material which absorbs or attenuates vibration, but also has the function of exerting an external force on the attachment piece of the attaching member, and consequently, mechanically keeping vibration from being generated in the attachment piece of the attaching member as its main function.

Exemplary Embodiment C1

Figure 21:
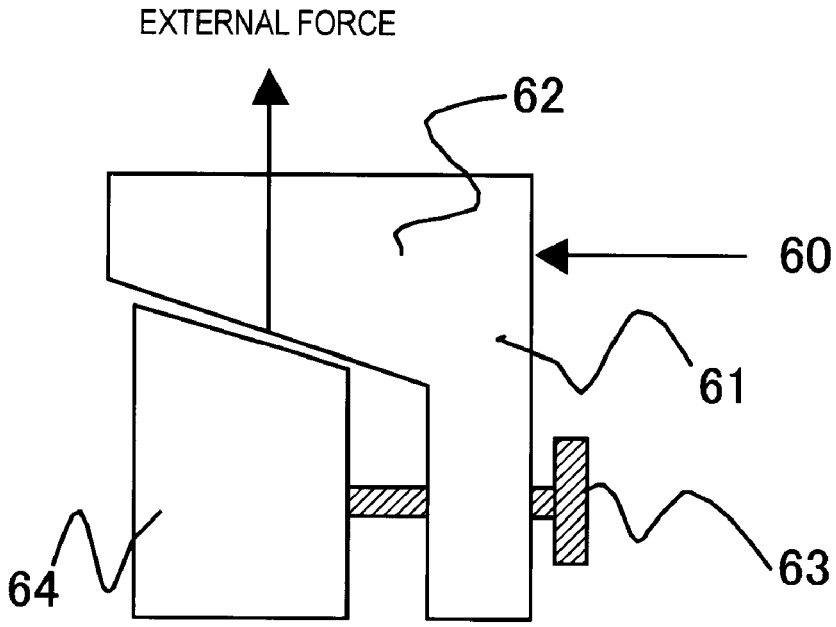
FIG. 21 is a configuration diagram showing chief parts of a cleaning device according to an exemplary embodiment C1 of this invention.

FIG. 21 shows an exemplary embodiment C1 of this invention, and description will be made with the same reference numerals being given to the same portions as the exemplary embodiment A1. In this exemplary embodiment, the surface of the housing member 64 which faces the second attachment piece 62 and the surface of the second attachment piece 62 which faces the housing member 64 form slopes, and when the housing member 64 is fastened by the fixing screw 63, an external force acts upward on to the bottom surface of the second attachment piece 62. The portion where the slope of this housing member 64 touches the slope of the second attachment piece 62 becomes an external force exerting portion.

Exemplary Embodiment D1

Figure 22:
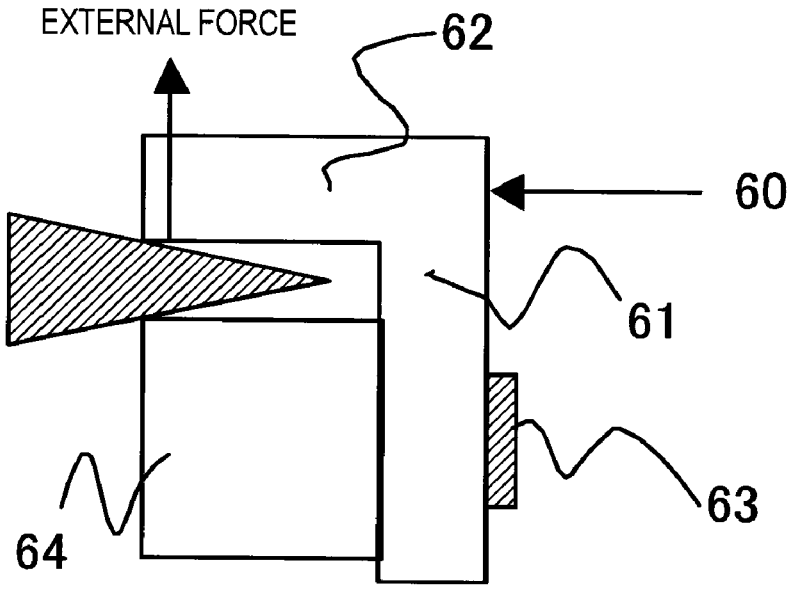

FIG. 22 shows an exemplary embodiment D1 of this invention, and description will be made with the same reference numerals being given to the same portions as the exemplary embodiment A1. In this exemplary embodiment, a wedge member is interposed between the housing member 64 and the second attachment piece 62, and an external force acts upward on the bottom surface of the second attachment piece. The portions where the wedge member contacts the housing member 64 and the second attachment piece 62 become external force exerting portions. As the material of the wedge member, for example, resin, an elastic body, metal etc. are mentioned.

What is claimed is:

1. A cleaning device comprising:

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a housing attachment member to which one of the first attachment piece and the second attachment piece is fixed at both ends along a longitudinal direction thereof; and an external force exerting member that exerts an external force in a direction which intersects a surface of the other one of the first attachment piece and the second attachment piece, which is not fixed to the housing attachment member, wherein the external force exerting member is an elastic member that is provided to the attachment piece which is not fixed to the housing attachment member, and that is interposed, in a compressed state, between the housing attachment member and the attachment piece which is not fixed to the housing attachment member.

2. The cleaning device according to claim 1, wherein the external force exerting member is a wedge-shaped member.

3. The cleaning device according to claim 1, wherein the elastic member is provided at both ends along a longitudinal direction of the attachment piece which is not fixed to the housing attachment member.

4. The cleaning device according to claim 3, wherein the elastic member is only provided at the both ends.

5. The cleaning device according to claim 1, wherein the elastic member is provided at a middle portion along a longitudinal direction of the attachment piece which is not fixed to the housing attachment member.

6. The cleaning device according to claim 5, wherein the elastic member is only provided at the middle portion.

7. A cleaning device comprising:

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a fixing member; and a housing member to which one of the first attachment piece and the second attachment piece is fixed at both ends along a longitudinal direction thereof by the fixing member, wherein a surface of the housing member faces a surface of the other one of the first attachment piece and the second attachment piece, which is not fixed to the housing member, and both of the surfaces are provided in a direction oblique to a fixing direction of the fixing member so as to exert an external force in a direction which intersects the surfaces.

8. An image forming apparatus comprising:

an image carrier on a surface of which a toner image according to image information is formed;

a transfer unit that transfers the toner image formed on the image carrier to a recording medium directly or via an intermediate transfer body;

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a housing attachment member to which one of the first attachment piece and the second attachment piece is fixed at both ends along a longitudinal direction thereof; and an external force exerting member that is provided at both ends of the other one of the first attachment piece and the second attachment piece, which is not fixed to the housing attachment member, and that exerts an external force in a direction which intersects a surface of the attachment piece not fixed to the housing attachment member, wherein the external force exerting member is an elastic member that is provided to the attachment piece which is not fixed to the housing attachment member, and that is interposed, in a compressed state, between the housing attachment member and the attachment piece which is not fixed to the housing attachment member.

9. The image forming apparatus according to claim 8, wherein the image carrier has a hard protective layer on a surface thereof.

10. An image forming apparatus comprising:

an image carrier on a surface of which a toner image according to image information is formed;

a transfer unit that transfers the toner image formed on the image carrier to a recording medium directly or via an intermediate transfer body;

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a housing attachment member to which one of the first attachment piece and the second attachment piece is fixed at both ends along a longitudinal direction thereof; and an external force exerting member that is provided at a middle portion of the other one of the first attachment piece and the second attachment piece, which is not fixed to the housing attachment member, and that exerts an external force in a direction which intersects a surface of the attachment piece not fixed to the housing attachment member, wherein the external force exerting member is an elastic member that is provided to the attachment piece which is not fixed to the housing attachment member, and that is interposed, in a compressed state, between the housing attachment member and the attachment piece which is not fixed to the housing attachment member.

11. The image forming apparatus according to claim 10, wherein the image carrier has a hard protective layer on the surface thereof.

12. An image forming apparatus comprising:

an image carrier on a surface of which a toner image according to image information is formed;

a transfer unit that transfers the toner image formed on the image carrier to a recording medium directly or via an intermediate transfer body;

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a fixing member; and a housing member to which one of the first attachment piece and the second attachment piece is fixed at both ends along a longitudinal direction thereof by the fixing member, wherein a surface of the housing member faces a surface of the other one of the first attachment piece and the second attachment piece, which is not fixed to the housing member, and both of the surfaces are provided in a direction oblique to a fixing direction of the fixing member so as to exert an external force in a direction which intersects the surfaces.

13. The image forming apparatus according to claim 12, wherein the image carrier has a hard protective layer on the surface thereof.

14. A cleaning device comprising:

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a housing member to which one of the first attachment piece and the second attachment piece is fixed at both ends along a longitudinal direction thereof; and an external force exerting member that exerts an external force in a direction which intersects a surface of the other one of the first attachment piece and the second attachment piece, which is not fixed to the housing member, wherein the external force exerting member is a wedge-shaped member.

15. An image forming apparatus comprising:

an image carrier on a surface of which a toner image according to image information is formed;

a transfer unit that transfers the toner image formed on the image carrier to a recording medium directly or via an intermediate transfer body;

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a housing member to which one of the first attachment piece and the second attachment piece is fixed at both ends along a longitudinal direction thereof; and an external force exerting member that is provided at both ends of the other one of the first attachment piece and the second attachment piece, which is not fixed to the housing member, and that exerts an external force in a direction which intersects a surface of the attachment piece not fixed to the housing member, wherein the external force exerting member is a wedge-shaped member.

16. An image forming apparatus comprising:

an image carrier on a surface of which a toner image according to image information is formed;

a transfer unit that transfers the toner image formed on the image carrier to a recording medium directly or via an intermediate transfer body;

a cleaning blade member that has a tip abutting a surface of an image carrier so as to remove a residue remaining on the surface of the image carrier;

an attaching member that comprises a first attachment piece to which a base end of the cleaning blade member is attached, and a second attachment piece which is provided so as to intersect the first attachment piece at a predetermined angle;

a housing member to which one of the first attachment piece and the second attachment piece is fixed at both ends along a longitudinal direction thereof; and an external force exerting member that is provided at a middle portion of the other one of the first attachment piece and the second attachment piece, which is not fixed to the housing member, and that exerts an external force in a direction which intersects a surface of the attachment piece not fixed to the housing member, wherein the external force exerting member is a wedge-shaped member.

* * * * *